United States Patent [19]

Davis et al.

[11] Patent Number: 4,470,356

[45] Date of Patent: Sep. 11, 1984

[54] WORD PROCESSOR-CONTROLLED PRINTER OUTPUT BIN LOCK BOX

[75] Inventors: David R. Davis; Sherman S. Kline; David A. Monroe; Elliot N. Tompkins; Victor D. Poor, all of San Antonio, Tex.

[73] Assignee: Datapoint Corporation, San Antonio, Tex.

[21] Appl. No.: 347,134

[22] Filed: Feb. 9, 1982

[51] Int. Cl.[3] ..... E05G 1/00

[52] U.S. Cl. ..... 109/24.1; 109/45; 232/1 R; 271/292

[58] Field of Search ..... 232/1 R, 4 D, 12, 47, 232/43.2, 43.1, 43.3, 43.4; 109/24.1, 47, 56, 69, 61, 62, 66, 69, 70, 73, 45; 271/287, 292; 312/183, 186, 188

[56] References Cited

U.S. PATENT DOCUMENTS

| | | | |
|---|---|---|---|
| 3,016,185 | 1/1962 | Osborne | 232/15 |
| 3,773,252 | 11/1973 | Jensen | 232/1 R |
| 4,299,382 | 11/1981 | Ichikawa | 271/287 |
| 4,370,006 | 1/1983 | Graef et al. | 232/15 |

*Primary Examiner*—Gene Mancene
*Assistant Examiner*—Kris R. Schulze
*Attorney, Agent, or Firm*—McCamish, Ingram, Martin & Brown

[57] ABSTRACT

A lockbox is provided for a word processor printer output bin attached to a printer. The lockbox, which is insertable and removable from the output bin, is locked in the bin upon insertion, and can only be removed by disengagement of a first locking means. The lockbox has a security door which is positioned in a paper receiving position upon insertion into the output bin and which must be closed in order to remove the lockbox from the output bin.

10 Claims, 13 Drawing Figures

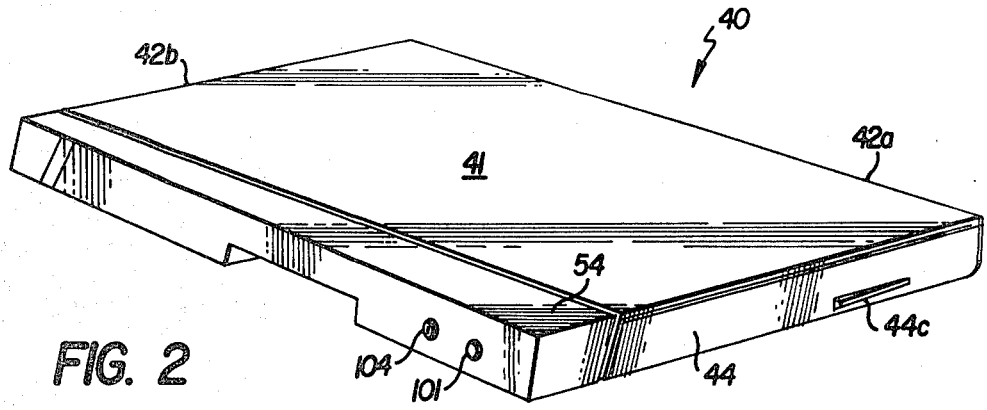
FIG. 2
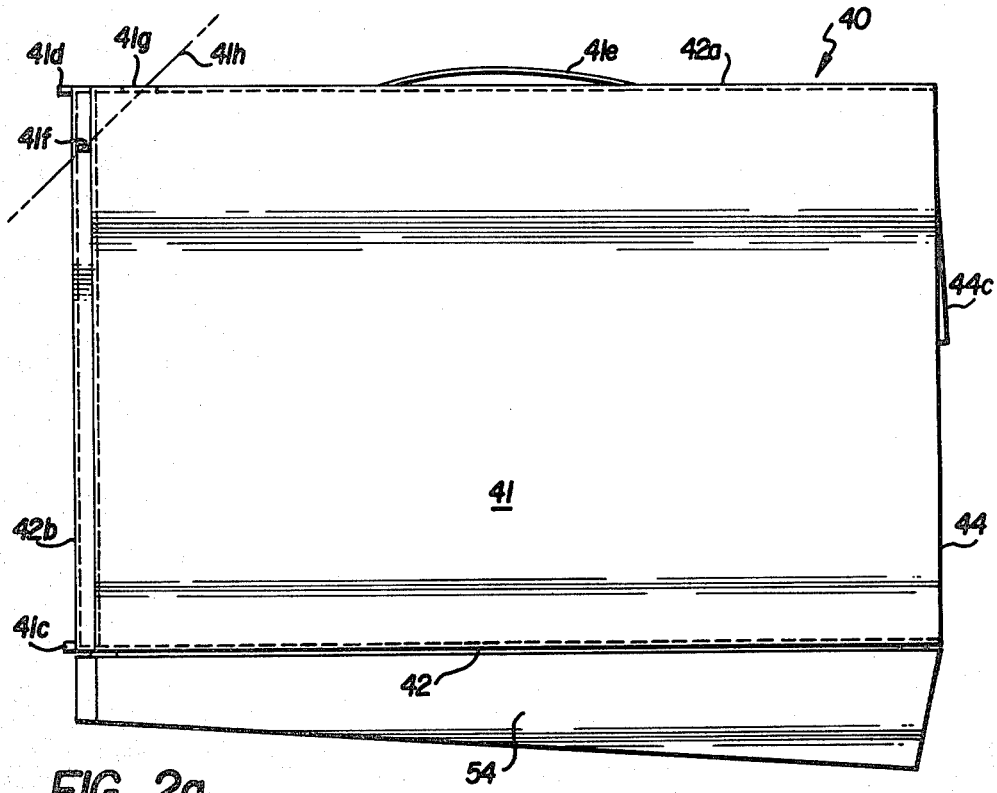
FIG. 2a
FIG. 2b
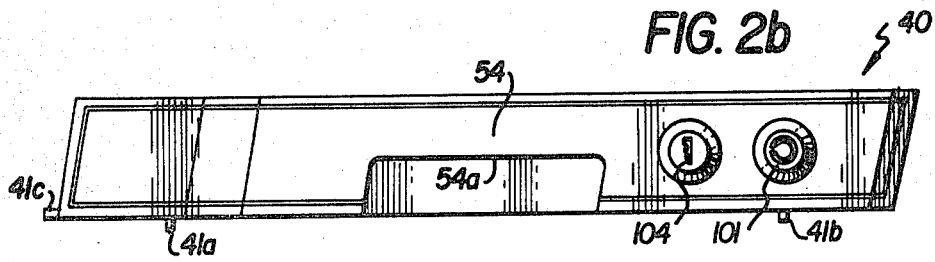

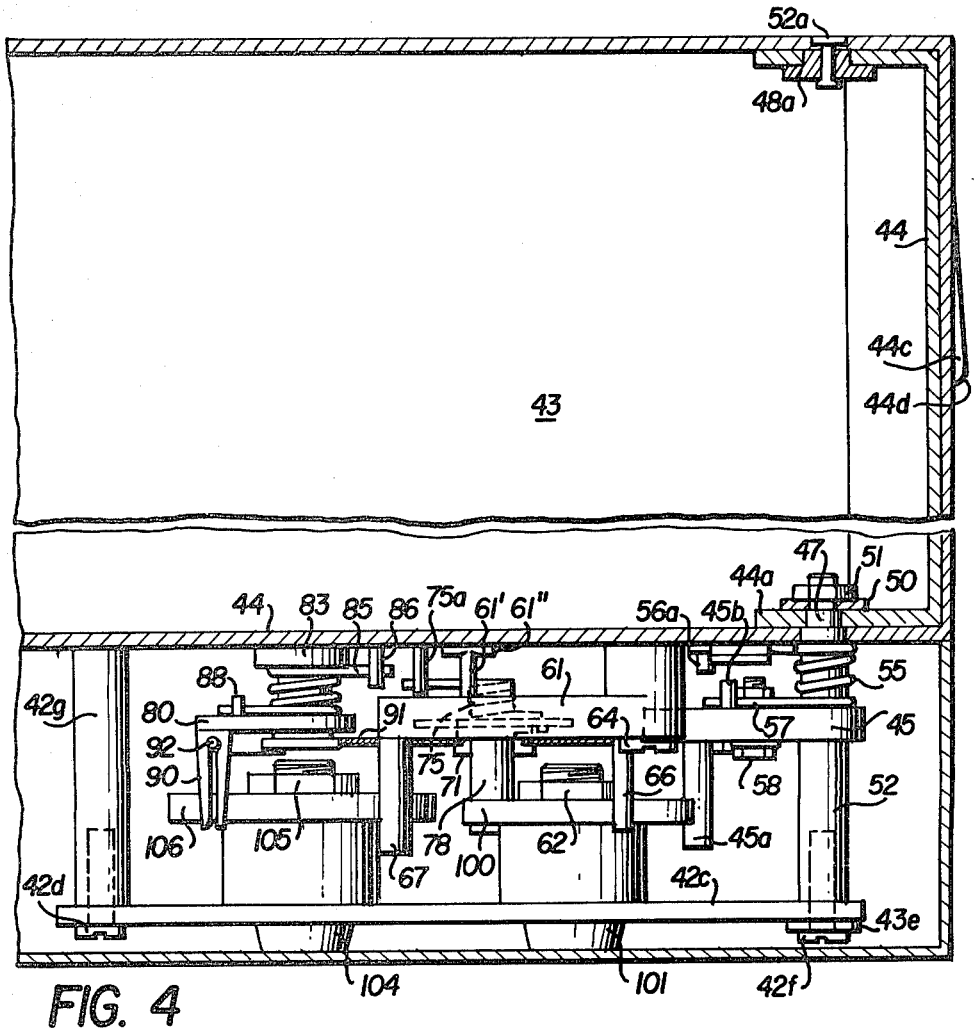
FIG. 4
FIG. 5
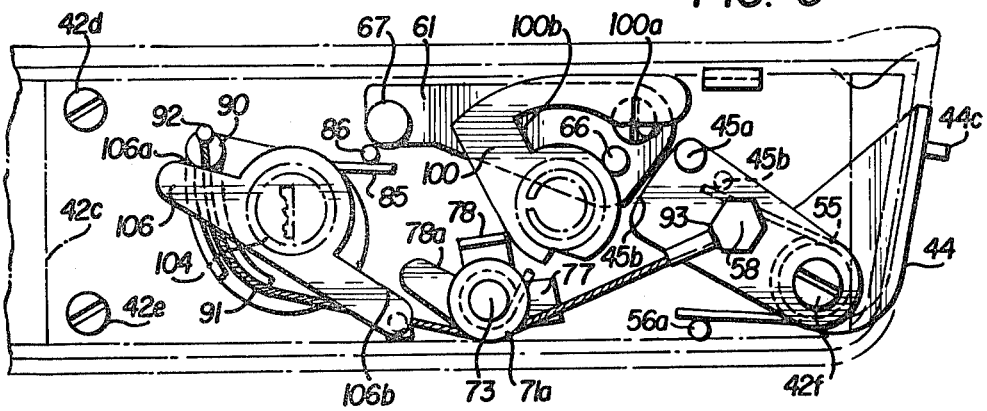

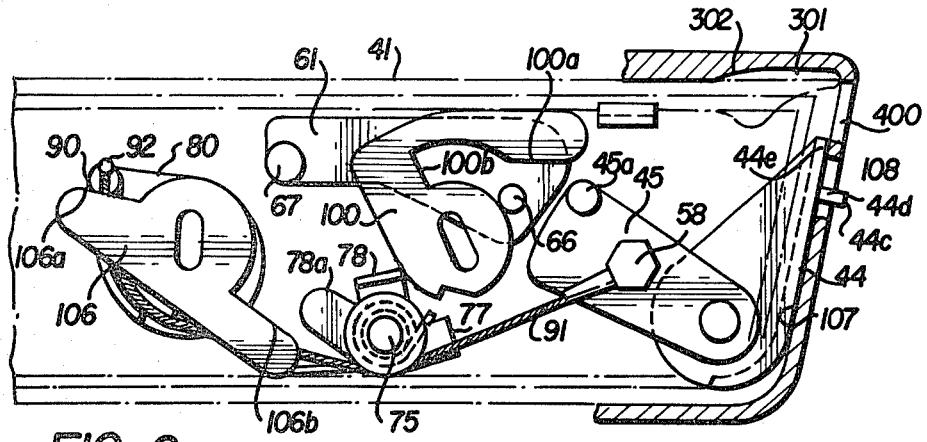
FIG. 6a
FIG. 6b
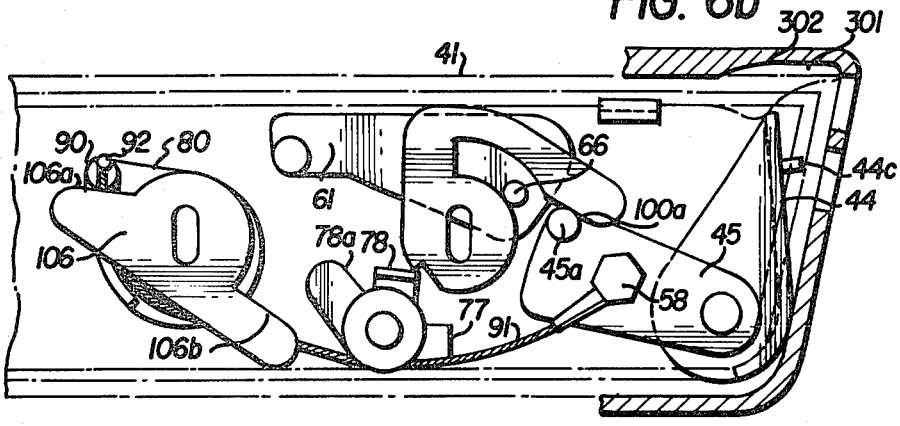
FIG. 6c
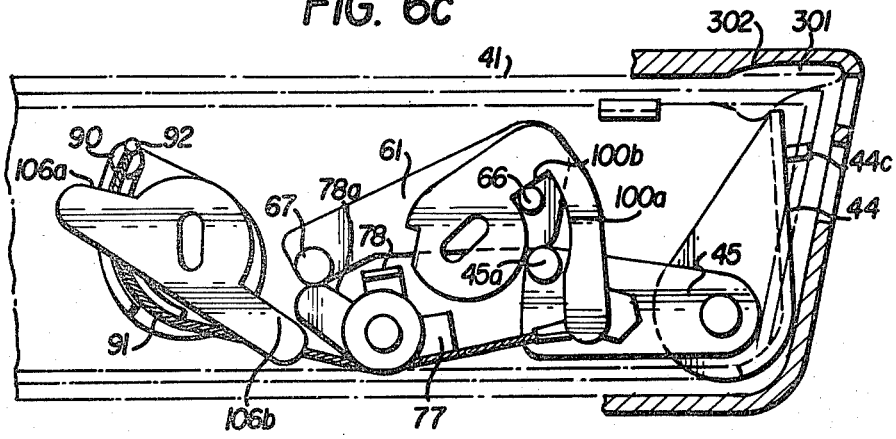

WORD PROCESSOR-CONTROLLED PRINTER OUTPUT BIN LOCK BOX

INCORPORATION BY REFERENCE

Applicant(s) hereby Incorporate(s) by Reference the structural details and descriptions included in the following Patent Applications:

(1) United States Patent Applications:

"Word Processor - Controlled Printer Output Bin Scanner Mechanism", Ser. No. 321,808, filed on Nov. 16, 1981, in the names of Elliot N. Tompkins and Sherman S. Kline;

"Connecting Mechanism For Word Processor - Controlled Printer Output Module Cabinets", Ser. No. 321,807, filed on Nov. 16, 1981, in the names of Franklyn H. Witten and Sherman S. Kline; and "Word Processor - Controlled Printer Paper Transport", Ser. No. 322,095, filed on Nov. 16, 1981, in the name of Sherman S. Kline.

BACKGROUND OF THE INVENTION

This invention relates generally to a word processor output bin lockbox for use with word processing machines. In particular, it relates to a lockbox for inserting in an output bin of a word processor - controlled printer to limit access to printed documents to authorized personnel.

The use of high speed word processing equipment is becoming commonplace in businesses. The system generally includes word processing stations for an operator who keys information into a word processor which records the information on a recording medium such as magnetic disc, tape or other memory. The memory directs the coded information to a printer or image reproducer which may be an electrophotographic printing mechanism such as a laser printer. The printer is coupled to a paper supply source and a paper handling mechanism directs paper from the paper supply source through a printer which can have the ability to print data, text and graphic information on the paper. The paper handling mechanism then directs the finished product to a paper receiving station or output bin.

A problem exists with maintaining confidential or sensitive documents in confidence when the printer and output bins are located at a central remote location where unauthorized personnel have access to the output bins. Most businesses require that certain information be limited in access to certain personnel. The invention is directed to a security means to solve the problem of limiting access to authorized personnel by providing an output bin lockbox which can be inserted in an output bin and locked in position to receive printed documents and which can only be removed by an authorized operator who has the code or key to remove the lockbox from the output bin.

Another problem solved by the invention is that upon removal of the lockbox from the output bin, the lockbox is closed so that no one can obtain access to the documents except a person having a second code or key to open the box and retrieve the printed documents. Other objects of the invention will be apparent from the detailed description of the invention.

BRIEF SUMMARY OF THE INVENTION

The invention comprises a word processor—controlled printer output bin lockbox which can be inserted and removed in an output bin of an output module attached to a printer. The lockbox is locked in position in the output bin upon insertion and can only be removed upon disengagement of a first locking means through a code or key mechanism. The lockbox includes a security door which is automatically positioned to a paper-receiving position upon insertion in the output bin and which must be moved to a closed security position to remove the lockbox from the output bin. The lockbox can only be opened by an authorized person who has a code or key to a second locking mechanism which will open the lockbox for removal of paper documents therein. The lockbox has means to allow determining if it is full or is capable of receiving documents when positioned in the output bin. It is made of an opaque material which provides security against unauthorized viewing of any documents therein.

BRIEF DESCRIPTION OF THE DRAWINGS

FIG. 2 shows the lockbox of the invention.

FIG.2A is a plan view of the lockbox of the invention.

FIG. 2B is an elevation view of the lockbox of the invention.

FIG. 4 is a partial plan view showing the locking mechanism of the lockbox.

FIG. 5 is a partial elevation view showing the details of the locking mechanism.

FIG. 6A shows the paper receiving door of the lockbox in its paper receiving position when inserted in an output bin.

FIG. 6B shows the locking door being moved to its locking position for removal of the lockbox from the paper receiving bin.

FIG. 6C shows the locking mechanism being moved in its fully locked position for removal of the first key.

DETAILED DESCRIPTION OF THE INVENTION

Figure 1:
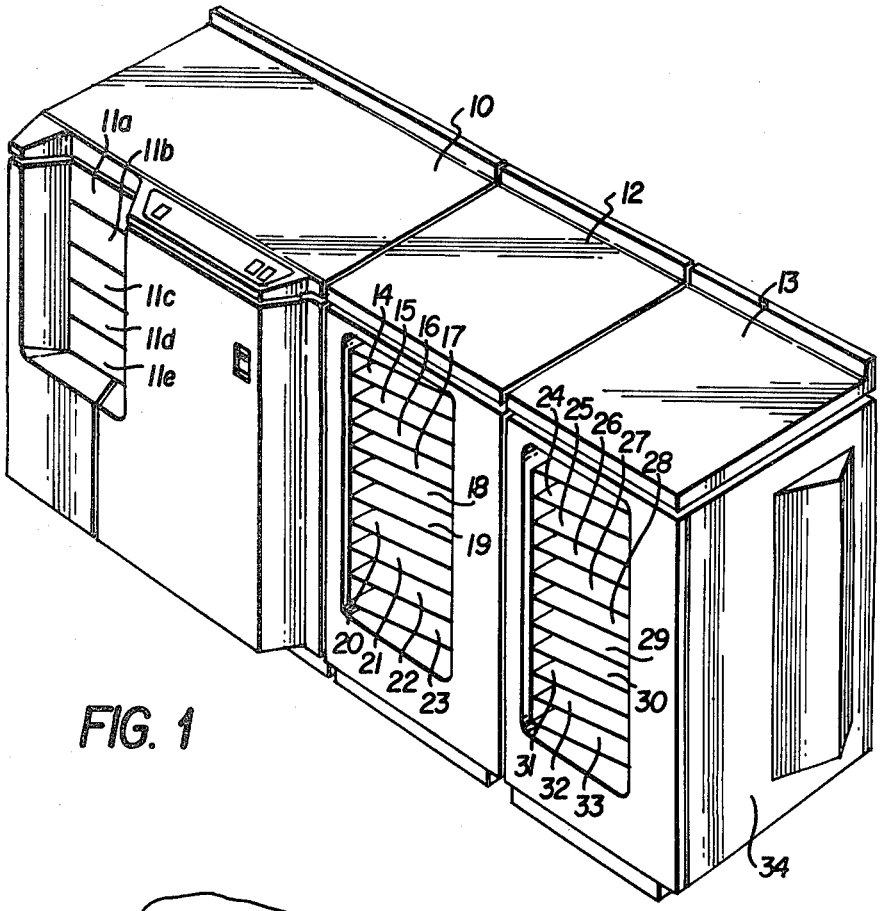
FIG. 1 is a view of a printing apparatus having a plurality of output bin modules connected to the printing apparatus for receipt of printed documents.

Referring to the drawing, there is shown a printer mechanism 10 which includes a plurality of paper supply bins 11*a*, 11*b*, 11*c*, 11*d* and 11*e* which selectively supply a predetermined type and size of paper to a printing mechanism (not shown) of conventional construction positioned within the cabinet of the printer mechanism 10. Removably connected with the printer mechanism 10 are a plurality of output bin modules 12 and 13 which are removably connected with the printer mechanism for receiving paper which has been processed with printing.

Each module includes a plurality of output bins 14, 15, 16, 17, 18, 19, 20, 21, 22, 23, 24, 25, 26, 27, 28, 29, 30, 31, 32, and 33. Although only two output bin modules are shown, it is understood that the cabinet wall 34 can be removed to add as many as six additional output bin modules.

A paper feeding mechanism (not shown) supplies printed documents to a selected one of the output bins 14–33 in response to a computer apparatus which controls a feeder mechanism which selectively directs each sheet of paper from the printer mechanism 10 to a predetermined output bin.

The printing apparatus within the printer mechanism 10 may be of the laser printer type or other electrophotographic engine. The paper supply bin 11*a*, 11*b*, 11*c*, 11*d*, and 11*e* are controlled by the computer apparatus to determine which type and size of paper are supplied to the printer contained within the printer mechanism 10. The printer mechanism 10 may be of the type which prints on one side or both sides of the paper. In normal operation the paper which is processed through the printer of the printer mechanism 10 would be directed by a paper feeding means to a predetermined one of the output bins 14–33 by the paper transporting mechanism. An operator would then remove the printed material from the selected bin.

Figure 2C:
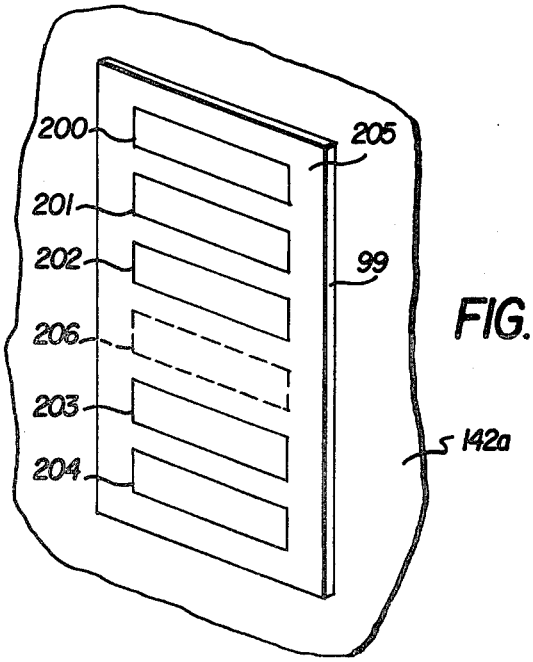
FIG. 2C is a section taken along lines 2C—2C in FIG. 2A

Referring to FIGS. 2, 2*a* and 2*b* of the drawings, there is shown a lockbox 40 which is inserted in and received by any one of the output bins 14–33. One or more lockboxes could be inserted in the output bins when it was desired to retain the documents fed into the selected output bin in confidence.

Each lockbox is basically an enclosed generally rectangular box constructed of opaque, perferably static free, plastic material that is inserted into a selected one of the output bins. The lockbox 40 has a set of locks on its face with one lock available to the user or source of the documents which are fed into the lockbox and who is the ultimate receiver of the documents. When the box is empty and has been present by a master key, it then can be carried to the machine by messenger or other personnel and inserted into the appropriate bin location in the machine. Each lockbox includes a door at one end which can be positioned to receive documents, retain documents in confidence, or move to an open position for removal of the documents. When inserted in the output bin, the door on the lockbox is in a paper receiving position. The lockbox can only be removed from the machine by a person who has a second key. Upon actuation of the second key mechanism, the door on the lockbox is moved from a paper receiving position to a locked position closing the box and preventing removal of documents from the box, except by someone who has the master key mechanism. The second key mechanism can only be used to close the paper receiving door which allows removal of the lockbox from the output bin. The lockbox cannot be removed from the output bin without positioning the paper receiving door to its locked position.

The exterior components of the lockbox 40 are shown in FIGS. 2, 2*a*, 2*b*, and 2*c* of the drawings.

Each lockbox 40 includes top portion 41, side portions 42 and 42*a*, end portion 42*b* and bottom portion 43. The top portion 41 has upwardly extending ear portions 301 (See FIG. 6A–C - only one shown) formed therein which extend the length of the lockbox at opposite sides thereof and cooperate with a static-reducing rib 302 extending the width and depth of each output bin to reduce static on paper entering the lockbox and to insure a snugger fit of the lockbox in its output bin. A door 44 is pivotally connected to the sides 42 and 42*a* for selectively allowing feeding of paper into the box when positioned in the output bin, for locking the box to prevent removal of the documents from the box and to open the box to allow removal of documents from the box.

The lockbox 40 includes spring means to properly position it in one of the output bins. As shown in FIG. 2B, spring biased leg means 41*a* and 41*b* engage the floor of the output bin to move the top member 41 in engagement with the top of the output bin. This positions the lockbox to receive paper through its door. The spring biased members 41*c* and 41*d* engage a side wall of an output bin to also position the lockbox in a proper paper receiving position. It is understood that the spring biased leg members 41*a* and 41*b* and spring biased members 41*c* and 41*d* may be moved inwardly towards the box to allow insertion of the lockbox in a output bin. Upon fully inserting the lockbox in the output bin, the spring means biased the lockbox into engagement with the right side and top to properly position the lockbox for receiving paper.

A bowed spring member 41*e* engages the rear wall of the output bin. This maintains the lockbox in a nonpaper receiving position as more fully explained hereinafter, until the lockbox is pushed all the way in to engage a catch member which depresses the bowed spring member 41*e*. A slot 41*f* and another slot 42*g* to detect the presence or absence of documents in the lockbox. The bowed spring member 41*e* maintains the slots 41*f* and 41*g* out of alignment with the light beam 41*h* until the lockbox is fully pushed into position whereby it is locked or retained within an output bin. The light beam 48 detects when the lockbox is not in position since it cannot pass through the opaque walls of the lockbox and directs the paper feeding mechanism to not feed any documents into the lockbox until it is in its fully inserted position. A cut out 54*a* provides a hand grip to pull the lockbox from the output bin. It also facilitates insertion of the lockbox.

Figure 3:
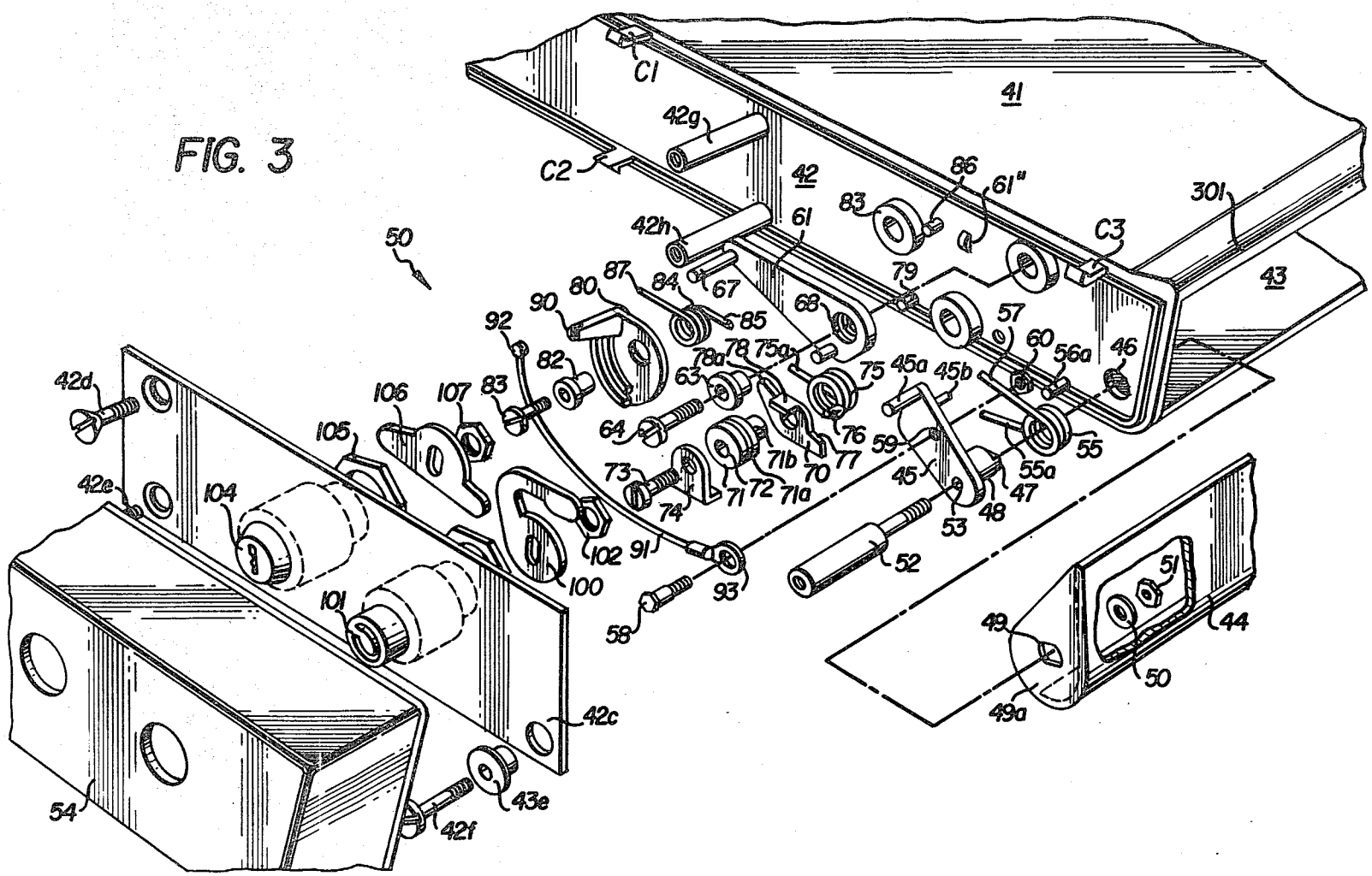
FIG. 3 is an exploded view of the lockbox showing the locking mechanism.

Referring to FIG. 3 of the drawing, a lock support plate 42*c* is shown. The lock support plate 42*c* is held in position by screws 42*d*, 42*e* and 42*f* which screw into standoff 42*g*, 42*h* and 52 respectively. Lock members 101 and 104 are connected to the lock support plate 42*c* by taps 103 and 105 respectively. A bushing 43*e* is mounted in the screw 42*f* to permit lever 45 to rotate freely.

Referring to FIG. 3, a door lever 45 is inserted through an aperture 46 in the side member 42. The door lever 45 includes a pin portion 48 terminating in a square portion 47 which mates with a square aperture 49 in the side wall 44A of the door 44. The standoff 52 is inserted through an aperture 53 in the door lever 45 and extends through the aperture 49 where it is connected with a washer 50 and nut 51 to secure the door lever 45 to the door 44 to control movement of the door. A similar bushing mechanism 48*a* and rivet 52*a* pivotally connects the other side of the door 44 to the side 42A of the lockbox 40.

The dual locking mechanism 50 is shown in exploded view in FIG. 3. The cover 54 is permanently attached to the side wall 42 of the box to cover the dual locking mechanism 50. Catches c1, c2, c3 and additional catches (not shown) secure the cover 54 permanently to the lockbox 40.

Figure 6D:
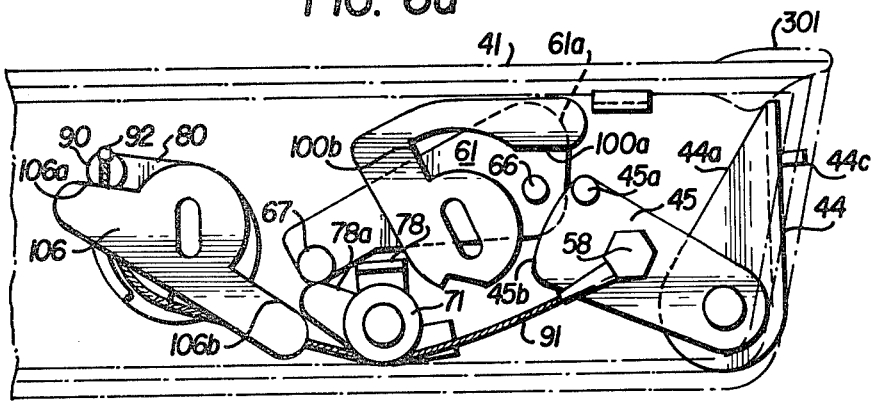
FIG. 6D shows the locking mechanism in fully closed and locked position whereby the first key may be removed.
Figure 6E:
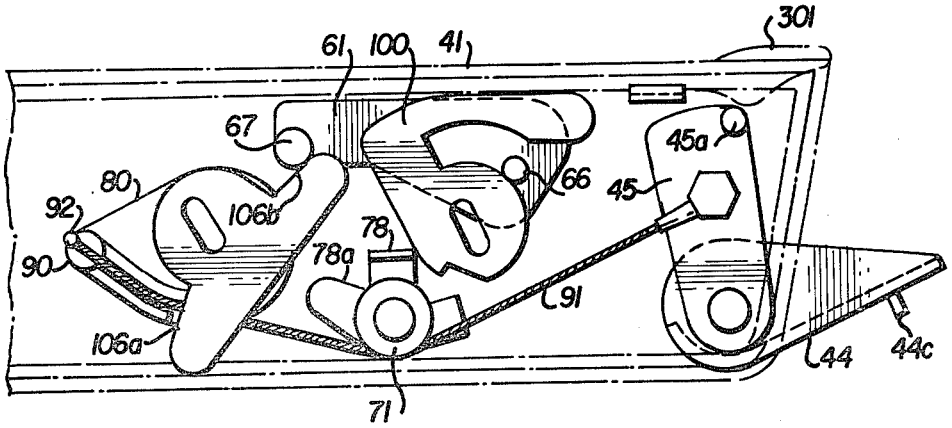
FIG. 6E shows the door of the lockbox in its open position for removal of documents from the lockbox.

A strong spring member 55 biases the door 44 to its open position as best shown in FIG. 6E. The spring 55 fits over the pin portion 48 and one end 55A of the spring extends behind pin 56*a*. Another end of the spring 57, is connected to the door lever 45 by pin 45*b*. The door spring 55 is sufficiently strong to maintain the door in its open position until it is closed manually. The door lever 45 includes a pin 45A for a purpose more fully explained hereinafter.

The locking mechanism further includes a door locking arm 61 which is pivotally connected to the wall 42 at 62. A bushing 63 extends through an aperture 68 in the door locking arm and is held in position by a bolt 64 which extends through an aperture in the bushing and connects to the wall on mounting bracket 62. This allows pivoting of the door locking arm 61 to its unlocked and locked position.

At first pin 66 is secured to the door locking arm 61 and a second pin 67 is likewise secured to the door locking arm 61 for purposes as more fully explained hereinafter.

A locking bracket 70 is pivotally mounted on bearing surface 71*b* on cable guide 71. The cable guide 71 includes an aperture 72 through which is inserted a bolt 73. A cable retaining bracket 74 is provided to secure a door cable with the cable guide. A locking bracket light spring 75 includes an end 76 which engages the lever arm 77 of the locking bracket 70. The bolt 73 is connected to wall connector 77*a* to secure the locking bracket 77 to the wall 42.

The locking member or bracket 70 includes a locking portion. 78 for a purpose more fully explained hereinafter. As will be apparent, the spring 75 biases the locking bracket 77 clockwise as shown in FIG. 5. The end 75A of the spring 75 engages pin 79 secured to the side wall 42 to provide the clockwise movement.

An oscillating cable retainer bracket 80 includes an aperture 81 through which is positioned a bushing 82. A screw 83 extends through an aperture in the bushing 82 for rotatably securing cable retaining bracket on the wall connector 83 on the side wall 42.

A spring 84 fits over the bushing 82 and an end 85 on the spring engages the pin 86 as best shown in FIG. 4. The other end 87 of the spring engages another pin 88 secured to the cable retaining bracket 80 to bias the cable retaining bracket in a clockwise direction as viewed in FIG. 5. The spring 84 does not exert as much force as does spring 55.

The cable retainer bracket 80 includes a bifurcated post 90 which receives cable 91. A retainer 92 on the end of the cable 91 connects the cable 91 to the cable retainer bracket 80. An eye 93 on the other end of the cable is connected with the bolt 58 which extends through an aperture in the eye to connect the cable 91 to the door lever 45. The spring 55 biases the door 44 to its open position as shown in FIG. 6E. The spring 84 acts against the spring 55 through the cable 91. The cable 91 is best shown in FIG. 5 riding in a groove 71A in the cable guide 71. Cable retaining bracket 74 maintains the cable 91 in the groove 71A.

A door lock cam 100 is connected to a window lock 101 by tap 102. The window lock 101 is connected to the lock support plate 42C by a tap 103. The master or door unlock 104 is connected to the lock support plate 42C by a tap 105. A door unlock cam 106 is connected to the door lock 104 by a tap 107.

The door lock cam 100 includes a first camming surface 100A and a locking surface 100B. The door unlock cam 106 incudes a locking surface 106A and an unlocking surface 106B.

The locking and unlocking operation of the door 44 is as follows. Referring to FIG. 6A, the door 44 is shown in its paper receiving position with a gap at the upper end 44*e* allowing paper to enter the lockbox 40. When it is desired to insert the lockbox 40 into a bin in either the module 12 or 13, a user or operator need merely insert the box into the bin. A camming member 44C mounted on the door 44 engages the surface 107 of the bin wall as shown in FIG. 6A which moves the door out of the way so that the lockbox can be inserted in the closely fitting bin. When the lockbox is fully inserted in the bin, a notch 108 conforming to the shape of the camming member 44C receives the camming member 44C and allows it to move to the position shown in FIG. 6A. The surface 44*d* engages the notch 108 to lock and retain the lockbox in the output bin so that it can only be removed by someone who has a key to window lock 101. This aligns slots 41*f* and 41*g* with light beam 41*b* when spring 41*e* is depressed. This prevents any unauthorized person from removing the lockbox from the output bin. With the door in a position as shown in FIG. 6A, the box will receive paper from the printer mechanism 10 as directed by a central control computer. When it is desired to remove the lockbox from the output bin, it is necessary for someone to have a key to the lock 101. Upon insertion of a key in the lock 101, it is possible to rotate the door lock cam 100 so that the camming surface 100A engages the pin 45A as shown in FIG. 6B which rotates the lever 45 counter clockwise to move the door 44 to its locked security position. This releases the locking surface 44D on the camming member 44C so that the box can be removed from the bin. The locking portion 78 on the cable retaining bracket 74 is positioned so that it will engage a notch 109 in the door lock cam 100 to retain door lock cam 100 in its position as shown in FIG. 6B whereby the key cannot be removed from lock 101. The cable retaining bracket 74 with its locking portion 78, prevents a person with a key to lock 101 from removing the key without positioning the door 44 in its fully locked position as shown in 6C. Before the door 44 can be moved to its position where it releases the surface 44B from the notch 108, the locking portion 78 engages the notch 109 to retain the door 44 in its locked position even if the complete procedure is not followed to allow removal of the key from the window lock 101.

Further rotation of a key in the window lock 101 will cause the locking surface 100B to engage the pin 66 to move the door locking arm 61 so that its locking surface 61A engages the locking surface 45B on the door lever 45. This causes the door locking arm 61 to rotate to the position shown in FIG. 6D where the pin 67 engages surface 70*a* to pivot locking bracket 70 to move locking portion 78 away from notch 109. Only then can a key in lock 101 be rotated sufficiently counterclockwise to a position shown in FIG. 6E whereby the key can be removed. Failure to complete the locking procedure will alert the person who is to receive the confidential documents since the key to lock 101 has not been removed. With the door locking arm 61 in its position as shown in FIG. 6D, it will retain the door operating lever 45 in a position shown in FIG. 6D which locks the door 44 in its closed security position so that papers cannot be removed from the lockbox. The door lock cam 100 cannot be moved to its position shown in FIG. 6E which is the door open position with the key which operates the door lock cam 106. The locking surface engages pin 67 to raise and release the door locking arm 61. This allows the locking member to rotate clockwise to again engage door lock cam 100. Locking portion 78 on the locking bracket 70 may then engage the notch 109 upon repeating the steps for removal of the lockbox from an output bin.

In order to open the door 44 to its position as shown in FIG. 6E to allow access to the documents contained therein, it is necessary to have a key to the door lock 104. Upon insertion in a key in a door lock 104 a person is authorized to obtain the documents in the box may rotate the door unlock cam 106 so that its unlocking surface 10 allows the bifurcated post 90 to move downwardly as shown in FIG. 6C. The unlocking surface 106B engages the post or pin 67 which moves the door locking arm 61 out of engagement with the door lever 45. The spring 55 then causes the door 44 to move to its open position to allow an authorized person to remove any documents contained in the lockbox.

A person having a key to the lock 104 may then reposition the door 44 to its paper receiving position as shown in FIG. 6A by rotating the key clockwise which disengages the unlocking surface 106B from the pin 67 and pulls the cable 91 to the left which moves the door upwardly from its position in FIG. 6E to its position in FIG. 6A. The door locking arm 61, through its locking surface 61A, engages the locking surface **45*b* to retain the door 44 in its paper receiving position. The steps may then be repeated whereby a user inserts the lockbox in a storage bin until it is locked therein by the camming member 44C which is retained in notch 108 until the window lock 101 is again actuated to remove the box from the output bin and lock the door 44** at the same time to securely retain the documents within the box.

As is shown in greater detail in copending U.S. patent application Ser. No. 322,095, filed on Nov. 16, 1981, and entitled "Word Processor-Controlled Printer Output Scanner Mechanism", a retroreflective or transmissive assembly is secured on a tab member on the side of a carriage mounted for vertical movement relative to the output bin. The retroreflective assembly sends a light signal such as infrared light which impinges on a reflective strip 199 which is secured to the back side **142*a* of the lockbox 140. The reflective strip 199 (See FIG. 2C) includes a plurality of signal means 200, 201, 202, 203, and 204 which are covered by an opaque strip 205. The retroreflective assembly detects the presence or absence of the signal means 200–204 through opaque material, covering the reflective strip 199 to locate a specific lockbox having the appropriate code. This is accomplished using a binary system whereby the retroreflective assembly 196 can detect the presence or absence of a signal means 200–204. Schematically shown at 206** is the absence of a signal means. The presence of the signal means could be assigned a 1 or a 0 which would provide a binary signal to the control for the printer mechanism to determine the location of a specific lockbox and direct documents to that lockbox. It is understood that different arrangement of the signal means could be provided so that numerous lockboxes could be utilized and differentiated between when positioned in the output bin.

Although the invention has been described in conjunction with the foregoing specific embodiment, many alternatives, variations and modifications are intended to fall within the spirit and scope of the appended claims.

I claim:

1. A printer mechanism comprising:

a printer mechanism having at least one output bin;

a lockbox for lockably positioning in said output bin to receive paper from the printer mechanism and made of opaque material to prevent viewing of printed matter on papers in the lockbox;

said lockbox having an open end with an opaque door mounted with the box at the open end and movable between a fully locked position, preventing removal of papers from the lockbox, a paper receiving position for allowing papers to be directed into the lockbox from a printer and to lockably position the lockbox in the output bin and an open position to allow an authorized user to remove papers from the box upon removal from the output bin; and a locking means for releasing the lockbox from the output bin and to allow removal of the lockbox from the output bin upon movement of the door to the locked position and to release the door and allow movement of the door to the open position to control access to documents in the lockbox to prevent unauthorized access to papers in the lockbox.

2. The apparatus as set forth in claim 1, wherein:

the locking means includes a first means operatively connected with the door for releasing the lockbox from an output bin to allow removal of the lockbox from an output bin and provide movement of the door to the locked position.

3. The apparatus as set forth in claim 2, wherein:

the locking means includes a second means operatively connected with the door to release the door and allow movement of the door to the open position only when the second means is actuated to prevent unauthorized access to papers in the lockbox.

4. The apparatus as set forth in claim 1, wherein:

the locking means includes a first locking member which retains the door in its locked position upon release of the lockbox from its locked position in the printer output bin.

5. The apparatus as set forth in claim 2, wherein:

the locking means includes a second locking member which is operatively connected with the first means and is actuated upon releasing the lockbox from the output bin to prevent removal of a key from the first means until the key is rotated to a fully locked position.

6. A word processor-controlled printer output bin lockbox apparatus comprising:

a generally rectangular lockbox for lockably positioning in an output bin of a printer to receive paper from the printer and made of opaque material to prevent viewing of printed matter on papers in the lockbox;

said lockbox having an open end with an opaque door mounted with the box at the open end and movable between a fully locked position preventing removal of papers from the lockbox, a paper receiving position for allowing papers to be directed into the lockbox from a printer and an open position to allow an authorized user to remove papers from the box upon removal from a word processor-controlled printer output bin; and a locking means on the lockbox having a first means operatively connected with the door for releasing the lockbox from an output bin to allow removal of the lockbox from an output bin and provide movement of the door to the locked position; and said locking means having second means operatively connected with the door to release the door and allow movement of the door to the open position only when the second means is actuated to prevent unauthorized access to papers in the lockbox.

7. The apparatus as set forth in claim 6, wherein:

the locking means includes a first locking member which retains the door in its locked position upon release of the lockbox from its locked position in a printer output bin.

8. The apparatus as set forth in claim 6, wherein:

a second locking member is operatively connected with the first means and is actuated upon releasing the lockbox from an output bin to prevent removal of a key from the first means until the key is rotated to a fully locked position.

9. The apparatus as set forth in claim 6, wherein:

the first locking member is operatively connected with the second means for releasing the door to its open position.

10. The apparatus as set forth in claim 6, wherein:

the locking means include means operatively connected with the first and second means to retain the door in a locked position and release the door to the open position.

* * * * *